US006776351B2

(12) United States Patent
Kobayashi et al.

(10) Patent No.: US 6,776,351 B2
(45) Date of Patent: Aug. 17, 2004

(54) EXPANSION VALVE

(75) Inventors: Kazuto Kobayashi, Tokyo (JP); Kazuhiko Watanabe, Tokyo (JP); Masamichi Yano, Tokyo (JP)

(73) Assignee: Fujikoki Corporation, Tokuo (JP)

( * ) Notice: Subject to any disclaimer, the term of this patent is extended or adjusted under 35 U.S.C. 154(b) by 0 days.

(21) Appl. No.: 10/614,057

(22) Filed: Jul. 8, 2003

(65) Prior Publication Data

US 2004/0026523 A1 Feb. 12, 2004

(30) Foreign Application Priority Data

Jul. 17, 2002 (JP) ..... 2002-208219
Aug. 28, 2002 (JP) ..... 2002-248686

(51) Int. Cl.[7] ..... F25B 41/04
(52) U.S. Cl. ..... 236/92 B; 62/225
(58) Field of Search ..... 62/225; 236/92 B

(56) References Cited

U.S. PATENT DOCUMENTS 2,508,010 A 5/1950 Bower
3,388,864 A 6/1968 Noakes
3,478,774 A 11/1969 Noakes et al.
5,060,485 A * 10/1991 Watanabe et al. ..... 62/225
5,127,237 A * 7/1992 Sendo et al. ..... 62/225
6,062,484 A * 5/2000 Eybergen ..... 236/92 B
6,112,998 A * 9/2000 Taguchi ..... 236/92 B
6,615,599 B1 * 9/2003 Pettitt et al. ..... 62/197

FOREIGN PATENT DOCUMENTS

EP 0947786 A2 10/1999
EP 0959310 A2 11/1999
EP 1262698 A2 12/2002
EP 1262699 A2 12/2002
GB 1379549 1/1975
JP 08-152232 A1 6/1996
JP 11-351440 A1 12/1999

OTHER PUBLICATIONS

European Search Report dated Dec. 12, 2003.

* cited by examiner

*Primary Examiner*—William E. Tapolcai
(74) *Attorney, Agent, or Firm*—Rader, Fishman & Grauer PLLC

(57) ABSTRACT

An expansion valve 1 comprises a housing 10 having refrigerant paths and a cassette unit 100. The cassette unit 100 comprises a flange 111 and a tube member 110 formed integrally thereto. An adjustment plate member 266 is mounted to the small-diameter end of the tube member 111 having steps, the plate member having an external thread 266*a* formed thereto. A bottom portion 46 of the inner bore of the housing for mounting the cassette is provided with an internal thread 46*a*. A head portion 121 of the lid member 120 of the cassette unit has a hexagonal shape, which enables the cassette unit 100 to be screwed onto the housing 10 using a tool such as a wrench.

4 Claims, 3 Drawing Sheets

EXPANSION VALVE

FIELD OF THE INVENTION

The present invention relates to an expansion valve for use in a refrigeration cycle of an air conditioner of a car or the like.

DESCRIPTION OF THE RELATED ART

For example, Japanese Patent Laid-Open No. 8-152232 discloses an expansion valve comprising an expansion valve body and a separately formed functional component containing a diaphragm chamber, wherein the expansion valve is formed by assembling this separately formed functional component to the valve body. Further, a spring is disposed within a temperature sensing case, enabling the length between the spring receiver to be controlled using a screw mechanism. A similar expansion valve structure is disclosed in Japanese Patent Laid-Open No. 11-351440.

According to the expansion valve disclosed in above-mentioned Japanese Patent Laid-Open No. 8-152232, the screw mechanism is equipped to the mounting portion of the temperature sensing case, and a screw mechanism is further utilized for fixing the body of the functional member to the valve body, by which the overall structure of the expansion valve becomes complex.

SUMMARY OF THE INVENTION

The object of the present invention is to provide an expansion valve comprising a piping member and a cassette unit provided with the functions of the expansion valve, so that the overall structure of the expansion valve can be simplified greatly.

The expansion valve according to the present invention comprises as basic components a housing with a refrigerant path to which is connected a pipe communicated with various devices of the air conditioner, and a cassette unit inserted to the housing. The cassette unit comprises a flange member, a tube member formed integrally with the flange member, a guide member, an orifice member and a plate member fixed to an interior of the tube member, a valve member disposed within a valve chamber defined by the orifice member, a spring disposed between the adjustment plate member defining the valve chamber and the valve member, biasing the valve member toward the orifice member, a shaft member for driving the valve member, a lid member welded onto the flange member, a diaphragm sandwiched between the lid member and the flange member and defining a gas charge chamber, and a stopper for transmitting a displacement of the diaphragm to the shaft member. Moreover, the housing further comprises an internal thread formed to a bottom of an inner bore portion for mounting the cassette unit, and the cassette unit further comprises an external thread formed to an outer circumference of the adjustment plate member.

DETAILED DESCRIPTION OF THE PREFERRED EMBODIMENT

Figure 1:
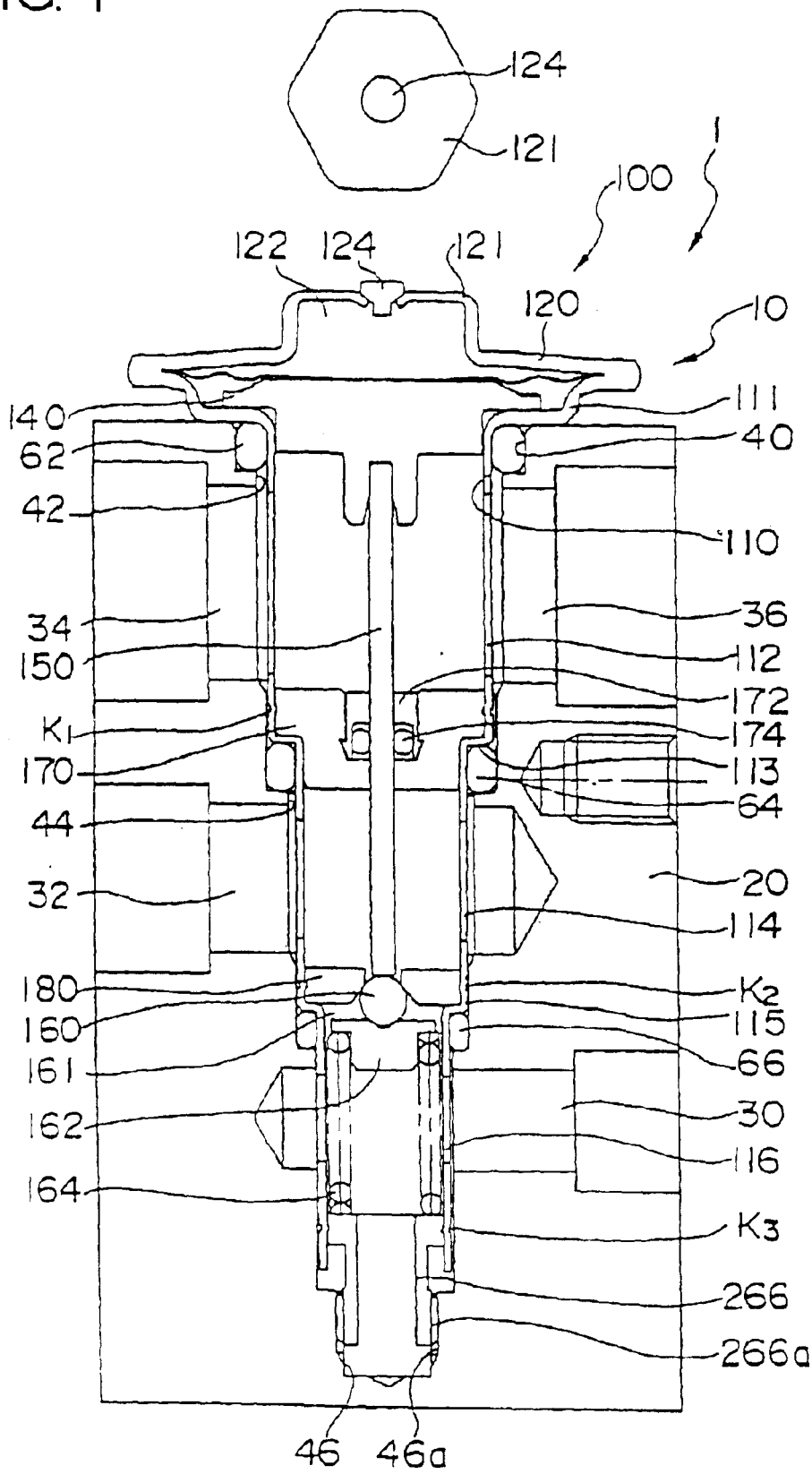
FIG. 1 is an explanatory view showing one embodiment of the present invention.

FIG. 1 is a cross-sectional view showing one preferred embodiment of an expansion valve having a cassette structure according to the present invention.

The expansion valve, the whole structure of which designated by reference number 1, comprises a housing 10 and a cassette unit 100 formed as separate components.

The housing 10 has a body 20 formed of an appropriate material such as aluminum, and to the body are provided a path 30 to which a piping for a refrigerant supplied from a compressor not shown is connected, a path 32 to which a piping for a refrigerant traveling toward an evaporator (not shown) is connected, a path 34 to which a piping for a refrigerant returning from the evaporator is connected, and a path 36 to which a piping for a refrigerant returning to the compressor is connected.

At the center of the body 20 in the direction orthogonal to the refrigerant paths are provided inner bore portions 40, 42, 44 and 46 with steps. The bore portion 46 constitutes a hole with a bottom, and comprises an internal thread 46*a*.

The cassette unit 100 accommodated in the bore portion formed to the body 20 of the housing 10 comprises a tube member 110 formed by drawing stainless steel material and the like. The tube member 110 is formed integrally with a flange portion 111, and provided with step portions 113 and 115. The end of the tube member 110 opposite from the flange portion 111 is opened.

A stopper 140 is disposed in the flange portion 111, and a diaphragm 130 comes into contact with the upper surface of the stopper 140. The circumference of the diaphragm 130 is sandwiched by a lid member 120 and the flange portion, and the lid member 120 is welded integrally thereto. The lid member 120 and the diaphragm 130 define a gas charge chamber 122, which is filled with a predetermined gas and sealed with a plug 124. The gas charge chamber 122 and the diaphragm 130 constitute the driving mechanism of the valve member.

A head portion 121 of the lid member 120 has a hexagonal planar shape, for example.

The tube member 110 is provided with through holes 112, 114 and 116 through which refrigerant travels. A shaft member 150 comes into contact with the lower surface of the stopper 140, the shaft member 150 passing through the guide member 170 and the orifice member 180, reaching a valve member 160 disposed within a valve chamber 161.

The spherical valve member 160 is supported by a support member 162, the support member 162 further supported via a spring 164 by an adjustment plate 266.

A seal member 174 is inserted to the guide member 170 and fixed thereto by a support member 172. The seal member 174 guides the shaft member 150 and seals any leak of refrigerant between the refrigerant path 32 leading to the evaporator and the refrigerant path 34 returning from the evaporator. The guide member 170 is fixed to the tube member 110 through a caulking portion $K_1$. Furthermore, the orifice member 180 and the adjustment plate 266 are also fixed to position by caulking portions $K_2$ and $K_3$, respectively.

Three seal members 62, 64 and 66 are fit between the cassette unit 100 and the bore portion of the body 20, forming a seal between the outer periphery of the cassette unit 100 and the bore portion of the body 20 of the housing 10.

According to this structure, the temperature of the low-pressure refrigerant passing through the refrigerant path 34, 36 from the evaporator toward the compressor is transmitted to the gas charge chamber 122 via the shaft member 150 and the stopper 140, by which the pressure of the refrigerant filled in the gas charge chamber 122 changes, and this change in pressure is transmitted via the diaphragm 130 and the shaft member 150 to the valve member 160, driving the valve member 160 to a position in which the above-mentioned pressure variation, the bias force of the spring 164 and the refrigerant pressure within paths 34 and 36 are balanced, and controlling the amount of refrigerant supplied from the compressor and passing the path 30 toward the evaporator.

The structure for fixing the cassette unit 100 to the housing 10 will now be explained.

An internal thread 46*a* is formed to the inner bore portion 46 at the bottom of the housing 10. Further, an external thread 266*a* is formed to the outer periphery of the adjustment plate 266.

A head portion 121 of the lid member 120 in the cassette unit 100 has a hexagonal planar shape. Thus, after inserting the cassette unit 100 together with seal members to the housing 10, a tool such as a wrench is applied to the head portion 121 of the lid member 120 in order to screw the external thread 266*a* of the adjustment plate 266 onto the internal thread 46*a* of the housing 10.

Along with this movement, the seal member 62 deforms elastically, and the cassette unit 100 is securely fixed to the housing 10.

Figure 2:
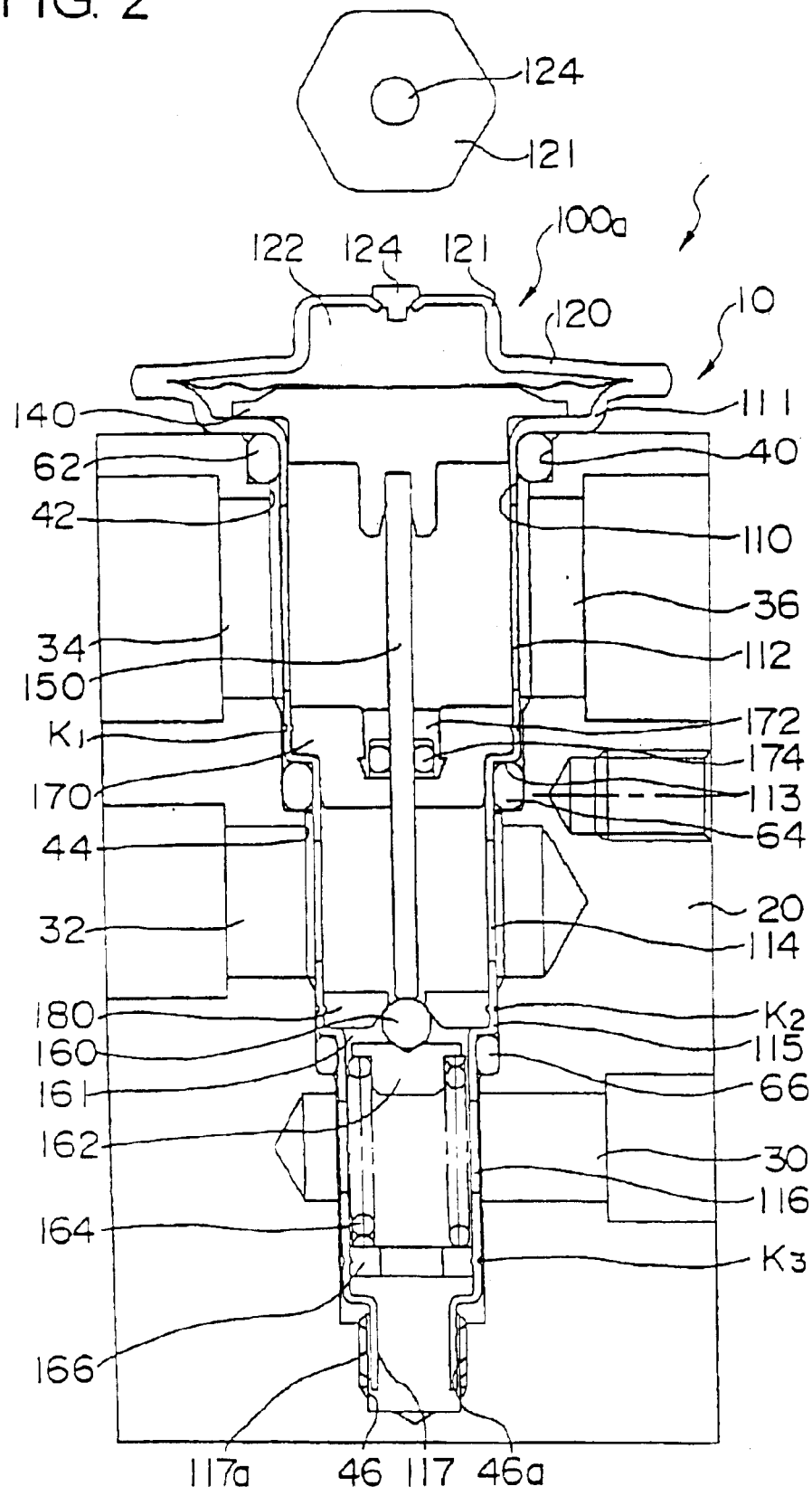
FIG. 2 is an explanatory view showing another embodiment of the present invention.

FIG. 2 is an explanatory view showing another embodiment of the present invention.

A cassette unit 100*a* of the present expansion valve comprises an integrally formed flange unit 111 and a tube member 110, and an external thread 117*a* is formed on the outer periphery at the lower end portion 117 of the tube member 110.

An internal thread 46*a* is formed on the inner diameter 46 at the bottom of the housing 10.

A head portion 121 of the lid member 120 in the cassette unit 100*a* has a hexagonal planar shape. Thus, after inserting the cassette unit 100*a* together with seal members to the housing 10, a tool such as a wrench is applied to the head portion 121 of the lid member 120 in order to screw the external thread 117*a* of the tube member 117 onto the internal thread 46*a* of the housing 10.

Along with this movement, the seal member 62 deforms elastically, and the cassette unit 100*a* is securely fixed to the housing 10.

Figure 3:
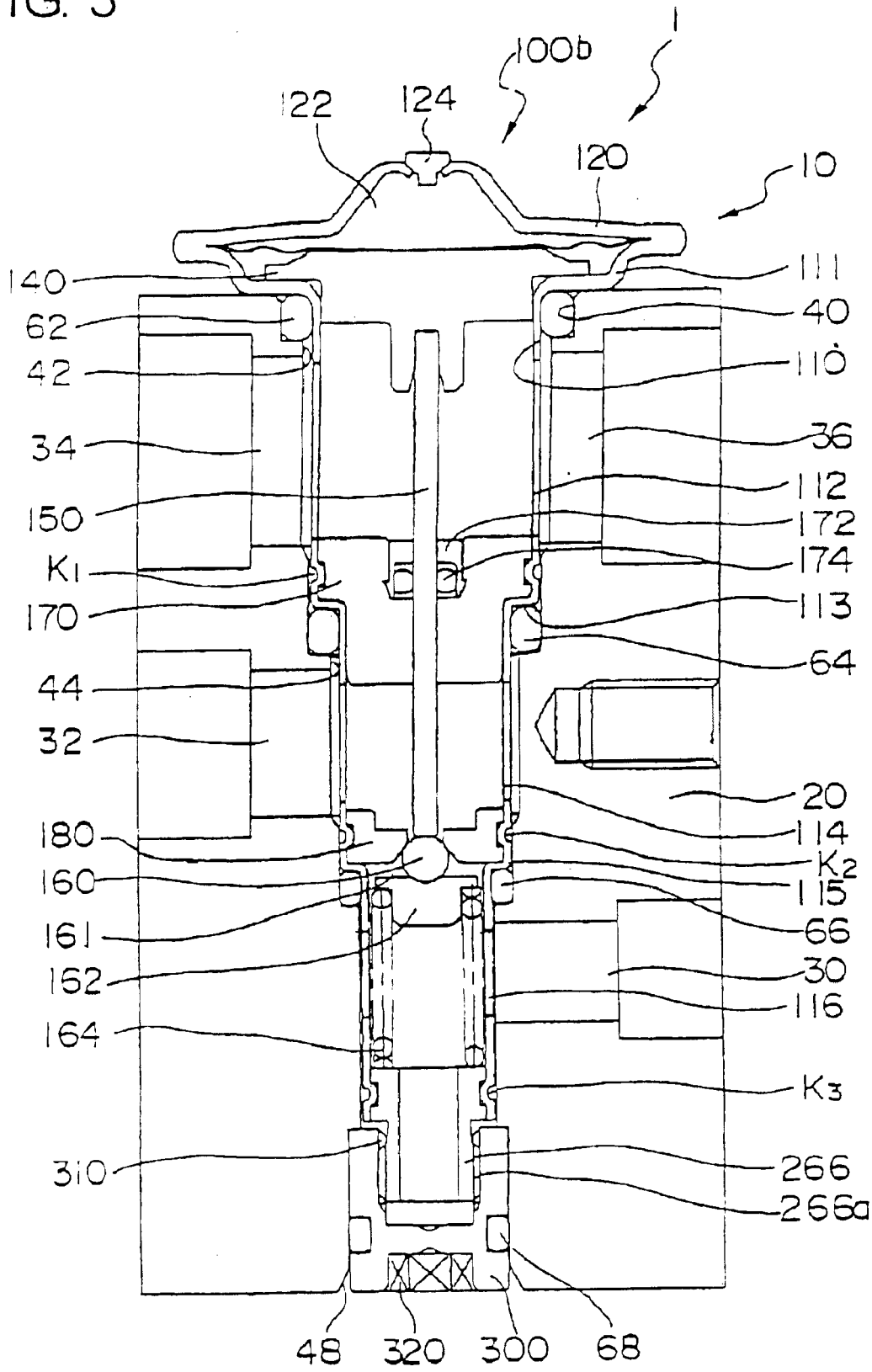
FIG. 3 is an explanatory view showing yet another embodiment of the present invention.

FIG. 3 is an explanatory view showing yet another embodiment of the present invention.

A cassette unit 100*b* of the present expansion valve comprises an adjustment plate 266 fixed to the lower end of a tube member 110, the adjustment plate 266 having an external thread 266*a*.

A plug member 300 is a cylindrical member inserted to an inner bore portion 48 formed to the bottom of a valve body 20, having an internal thread 310 that is screwed onto the external thread 266*a* of the adjustment plate 266 and a hexagonal bore 320. A seal member 68 is disposed to the outer periphery of the plug member 300.

The cassette unit 100*b* is mounted to the body 20 by the following procedure.

The cassette unit 100*b* is inserted to the inner bore of the body 20 in the axial direction. At this time, the cassette unit 100*b* is inserted to a position in which the through-holes 112, 114 and 116 of the tube member 110 correspond to the paths formed to the body 20.

Next, the plug member 300 is inserted to the inner bore 48 at the bottom of the body 20, and the internal thread 310 of the plug member 300 is screwed onto the external thread 266*a* of the adjustment plate 266. This operation is performed by inserting a hexagonal wrench to the hexagonal bore 320 of the plug member 300.

By screwing in the plug member 300, the cassette unit 100*b* is pulled inside the body 20 of housing 10, by which the seal member 62 deforms elastically, and the cassette unit is securely fixed to the body.

As explained, the present expansion valve comprises a housing to which are connected pipes communicating the valve with various equipments of the air conditioner, and a cassette unit equipped with the major components constituting the expansion valve, wherein the housing and the cassette unit are formed as separate components, and by assembling the cassette unit to the housing, the complete expansion valve is acquired.

A screw mechanism is applied as means to fix the cassette unit to the housing, according to which the whole structure of the valve is simplified.

What is claimed is:

1. An expansion valve to be equipped in an air conditioner to control the flow of a refrigerant, comprising:

a housing with a refrigerant path to which is connected a pipe communicated with various devices of the air conditioner; and a cassette unit inserted to the housing;

the cassette unit comprising a flange member; a tube member formed integrally with the flange member; a guide member, an orifice member and an adjustment plate member fixed to an interior of the tube member; a valve member disposed within a valve chamber defined by the orifice member; a spring disposed between the adjustment plate member defining the valve chamber and the valve member, biasing the valve member toward the orifice member; a shaft member for driving the valve member; a lid member welded onto the flange member; a diaphragm sandwiched between the lid member and the flange member and defining a gas charge chamber; and a stopper for transmitting a displacement of the diaphragm to the shaft member;

the housing further comprising an internal thread formed to a bottom of an inner bore portion for mounting the cassette unit; and the cassette unit further comprising an external thread formed to an outer circumference of the adjustment plate member.

2. An expansion valve to be equipped in an air conditioner to control the flow of a refrigerant, comprising:

a housing with a refrigerant path to which is connected a pipe communicated with various devices of the air conditioner; and a cassette unit inserted to the housing;

the cassette unit comprising a flange member; a tube member formed integrally with the flange member; a guide member, an orifice member and an adjustment plate member fixed to an interior of the tube member; a valve member disposed within a valve chamber defined by the orifice member; a spring disposed between the adjustment plate member defining the valve chamber and the valve member, biasing the valve member toward the orifice member; a shaft member for driving the valve member; a lid member welded onto the flange member; a diaphragm sandwiched between the lid member and the flange member and defining a gas charge chamber; and a stopper for transmitting a displacement of the diaphragm to the shaft member;

the housing further comprising an internal thread formed to a bottom of an inner bore portion for mounting the cassette unit; and the cassette unit further comprising an external thread formed to an outer circumference at a bottom end of the tube member.

3. An expansion valve according to claim 1 or claim 2, wherein the lid member of the cassette unit has a hexagonal planar shape.

4. An expansion valve to be equipped in an air conditioner to control the flow of a refrigerant, comprising:

a housing with a refrigerant path to which is connected a pipe communicated with various devices of the air conditioner; and a cassette unit inserted to the housing;

the cassette unit comprising a flange member; a tube member formed integrally with the flange member; a guide member, an orifice member and an adjustment plate member fixed to an interior of the tube member; a valve member disposed within a valve chamber defined by the orifice member; a spring disposed between the adjustment plate member defining the valve chamber and the valve member, biasing the valve member toward the orifice member; a shaft member for driving the valve member; a lid member welded onto the flange member; a diaphragm sandwiched between the lid member and the flange member and defining a gas charge chamber; and a stopper for transmitting a displacement of the diaphragm to the shaft member;

the cassette unit further comprising an external thread formed to an outer circumference of the adjustment plate member; and the expansion valve further comprising a plug member inserted to a bore portion formed to a bottom of the housing, the plug member having an internal thread to be screwed onto the external thread of the adjustment plate.

* * * * *